US010458738B2

(12) United States Patent
Albino

(10) Patent No.: US 10,458,738 B2
(45) Date of Patent: Oct. 29, 2019

(54) BLAST OVERPRESSURE REDUCTION FIREARM SYSTEM AND METHOD

(71) Applicant: Sergie A. Albino, Longwood, FL (US)

(72) Inventor: Sergie A. Albino, Longwood, FL (US)

( * ) Notice: Subject to any disclaimer, the term of this patent is extended or adjusted under 35 U.S.C. 154(b) by 0 days.

(21) Appl. No.: 15/951,372

(22) Filed: Apr. 12, 2018

(65) Prior Publication Data

US 2018/0299222 A1 Oct. 18, 2018

Related U.S. Application Data

(60) Provisional application No. 62/484,996, filed on Apr. 13, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/34; F41A 21/16; F41A 21/20; F41A 13/08
USPC ..... 89/14.2, 14.3, 14.4; 181/223
See application file for complete search history.

(56) References Cited

U.S. PATENT DOCUMENTS 4,024,790 A 5/1977 Heiderer
5,029,512 A * 7/1991 Latka ..... F41A 21/30 181/223
7,600,461 B1 * 10/2009 Cler ..... F41A 21/36 89/14.3
7,836,809 B2 11/2010 Noveske
8,047,115 B2 11/2011 Noveske
9,347,727 B1 5/2016 Cler
9,500,427 B1 11/2016 Larue
2011/0107900 A1 5/2011 Presz, Jr. et al.
2011/0252952 A1 10/2011 McNeill et al.
2015/0308772 A1 * 10/2015 James ..... F41A 21/30 89/14.4
2015/0308778 A1 * 10/2015 Vossler ..... F41A 21/36 89/14.3
2016/0363403 A1 12/2016 Kopecky
2017/0191780 A1 * 7/2017 Barrett ..... F41A 21/325

OTHER PUBLICATIONS

International Search Report, dated Aug. 1, 2018.

* cited by examiner

*Primary Examiner* — Michael D David
(74) *Attorney, Agent, or Firm* — Terry M. Sanks, Esq.; Beusse Wolter Sanks & Maire, PLLC

(57) ABSTRACT

A firearm overpressure reduction system is disclosed having a muzzle that further includes a converging section, a throat section and a diverging section. The converging section is in direct communication with the throat section that is in direct communication with the converging section. The converging section has a converging parabolic arrangement and the diverging section has a diverging parabolic arrangement that leads to an exit area for a bullet fired. Another system and methods are also disclosed.

10 Claims, 7 Drawing Sheets

BLAST OVERPRESSURE REDUCTION FIREARM SYSTEM AND METHOD

CROSS-REFERENCE TO RELATED APPLICATIONS

This application claims the benefit of U.S. Provisional Application No. 62/484,996 filed Apr. 13, 2017, the entire contents of which is incorporated herein by reference.

BACKGROUND

Embodiments relate to firearms and, more particularly, reducing blast overpressure to reduce negative effects on a shooter.

Individuals who use firearms on a regular basis encounter hazardous noise which can result in hearing loss. More specifically, firearm discharge typically produces a noise and concussive force that can damage hearing. An immediate effect of a firearm discharge results in a flinch response and momentary disorientation which can create vulnerabilities in the field such as, but not limited to, when a police officer is out on patrol. A more lasting effect is that the firearm discharge will eventually cause tinnitus and hearing loss, even with standard double protection for the ears.

A firearm produces a concussive force when discharged. The concussive force from an explosion travels on a wave called a shockwave. A shockwave is a propagating disturbance having a front wave where the leading side or edge is highly positive pressure (above normal atmospheric pressure). The leading edge of the shockwave caused when discharging a firearm is referred to as a blast overpressure (BOP) and a trailing side, or edge, is referred to as the underpressure. The real danger lies in the instantaneous change of overpressure to underpressure occurring and not giving the human body time to equalize pressure. To further clarify, blast overpressure and a shockwave are not the same as sound pressure. Damaging effects of a sound pressure wave are easily mitigated through commonly used ear protection devices. Neither BOP nor shockwave disclosed above can be mitigated such as through ear protection as both travel right through the body, devastating any cavity organs filled with gas, i.e., the sinuses, ear canal, lungs, heart. Continued exposure to BOP events will cause a cumulative effect which, over time, will cause damage such as ruptured eardrums, tinnitus, hearing loss, pain, vertigo, stress and heart conditions.

While prior art pistol or shotgun fire subsonic rounds (bullets) with relatively low BOP and with no shockwave, prior art high powered rifles firing supersonic rounds, inducing shockwaves and a much greater BOP continue to exist. For example, the M4 Rifle with a standard A2 Muzzle Brake (MB) is the rifle of choice for many law enforcement departments. This weapon fires a supersonic round that induces a shockwave and has a massive amount of BOP. This weapon has a shortened barrel length or an "SBR." Shortening the barrel further increases the BOP in addition to having that explosion and shockwave closer to the user's head and body significantly increasing damaging effects. These negative effects are known to be amplified as training and operating using these weapons may occur in close quarters such as, but not limited to, indoor firing ranges.

Furthermore, BOP experienced from prior art firearms can also affect how a user is using the firearm. BOP may result in impairment of a shooter's sight picture or ability to fire the weapon temporarily as a shockwave from pressure may contact the shooter's eyes and/or hands.

Additionally, when suppressors are used, they are attached to a standard muzzle break. None of the prior art provides for connecting a suppressor directly to a muzzle that reduces blast overpressure from a firearm discharge.

Manufacturers and users of firearms that produce potentially damaging blast overpressure when the firearm is fired would benefit from a system that reduces blast overpressure with and without a suppressor attached to the firearm.

SUMMARY

Embodiments relate to a system and method for reducing blast overpressure to reduce negative effects on a user of a firearm. The system comprises a muzzle that has a converging section, a throat section and a diverging section. The converging section is in direct communication with the throat section that is in direct communication with the converging section. The converging section has a converging parabolic arrangement and the diverging section has a diverging parabolic arrangement that leads to an exit area for a bullet fired. Another system comprises an overpressure reduction muzzle and a suppressor.

The method comprises directing a discharged bullet through a converging section of a firearm muzzle having a converging parabolic arrangement and directing the discharged bullet from the converging section through a throat section with an entrance in alignment with an end of the converging section. The method further comprises directing the discharged bullet from the throat section to a diverging section of the muzzle having a diverging parabolic arrangement and passing a discharge gas through the converging section, throat section and diverging section wherein the converging to diverging arrangement reduces a blast overpressure exiting an exit end of the diverging section.

Another method comprises directing a discharged bullet through an overpressure reduction muzzle and directing the discharged bullet through a suppressor.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
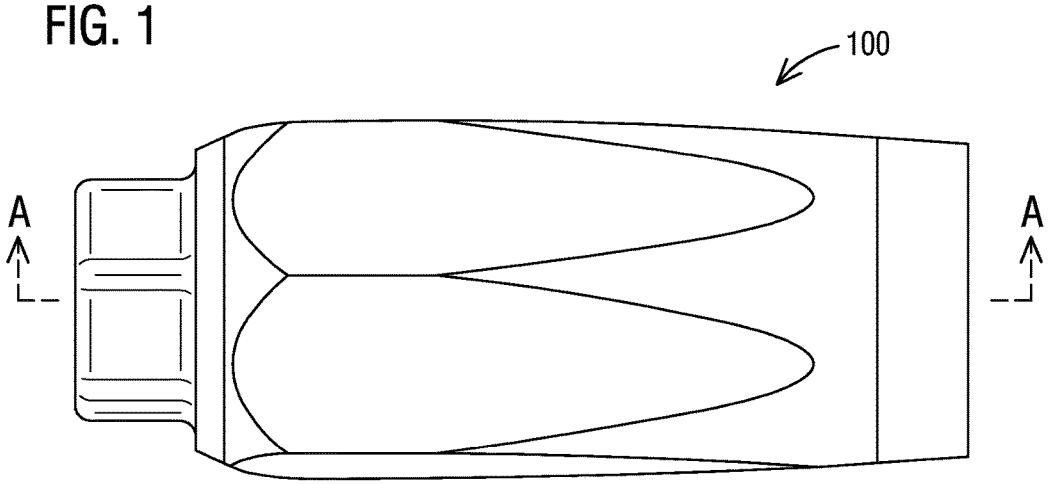
FIG. 1 shows an embodiment of a muzzle.

Embodiments are described herein with reference to the attached figures wherein like reference numerals are used throughout the figures to designate similar or equivalent elements. The figures are not drawn to scale, and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Figure 2:
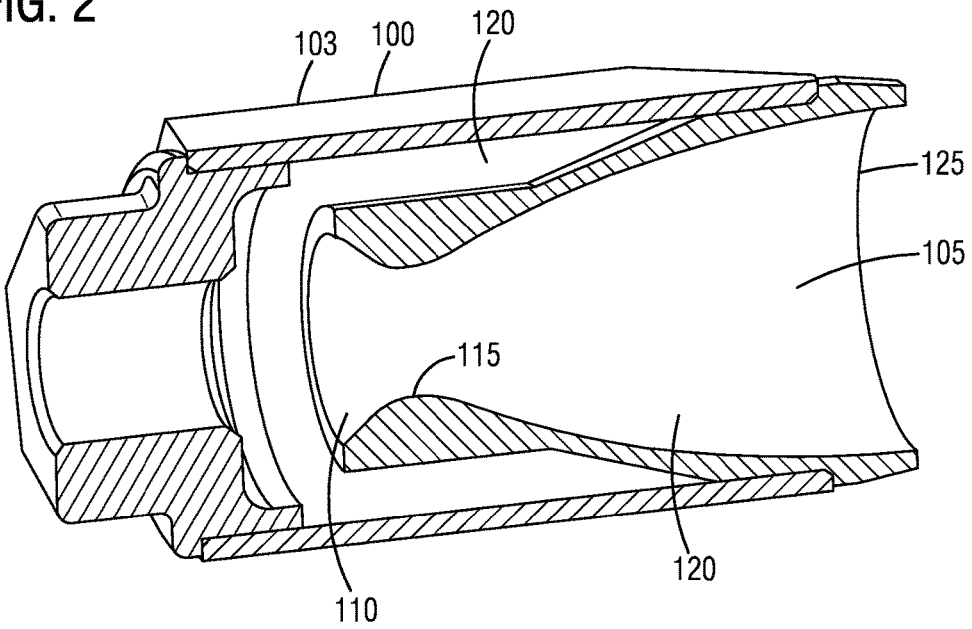
FIG. 2 is a cutout of the muzzle along A-A.

FIG. 1 shows an embodiment of a muzzle and FIG. 2 is a cutout of the muzzle along A-A. The muzzle 100 as disclosed herein is a firearm overpressure reduction system. As shown, an interior 105, or nozzle, of the muzzle 100 is shown having a converging section 110, a throat section 115 and a diverging section 120. An inner chamber 102 between the inner surface of the muzzle's cover 103 and an outer surface of the nozzle is shown. A bullet travels from the converging section 110 through the throat section 115 and then exits a firearm through the diverging section 120. Thus, the throat section 115 of the muzzle comprises a converging section in agreement, or aligned, with an exit end of the converging section and a diverging section that is in agreement, or aligned, with an entry end, or first end, of the diverging section to provide the exit area for the bullet fired.

More specifically, the bullet leaves a chamber of the firearm once an explosive charge in the bullet's primer is ignited, creating an increased pressure behind a core of the bullet. A core of the bullet passes through a minimum area, or the throat section 115 of a muzzle. Also, traveling from the chamber through the throat are discharge gasses and energy associated with firing of the weapon, which are associated with the blast overpressure ("BOP").

A size of the throat section 115 may be chosen so that the bullet core may pass safely through the muzzle 100 while choking the flow and a mass flow rate of discharge gasses and energy through the muzzle 100. The flow of discharge gasses in the throat 115 is at a specific speed. Downstream of the throat section 115, a geometry of the muzzle 100 diverges (within the diverging section) and the flow of the discharge gasses are isentropically expanded to a greater supersonic Mach number, wherein the Mach number is dependent on the area ratio of the exit of the muzzle to the throat. The expansion of the supersonic flow causes a static pressure, or the BOP, to decrease from the throat section 115 to the exit end 125. Therefore, in the embodiments disclosed herein, the expansion of the divergent section 120 also determines an exit pressure. Also, based on the embodiments disclosed herein, temperature of an amount the discharge gasses is also decreased from the throat section 115 to the exit end 125 of the nozzle 105.

The exit temperature determines the exit speed of sound, which determines the exit velocity. The exit velocity, pressure and mass flow through the muzzle determine the amount of discharge gasses produced when the weapon is fired. In the embodiments disclosed herein, the BOP is reduced.

The diverging section 120 may have a bell shape or parabolic shape. Utilizing this shape provides for a lighter muzzle brake while also providing for reduced overpressure.

The embodiments provided herein result in a blast overpressure out of the firearm to first expand in the muzzle brake's overpressure expansion chamber 101 prior to the flow converging at the first stage of the nozzle 105. Next, the blast then travels through the diverging section 120 of the nozzle 105, thereby significantly reducing the overpressure exiting the rifle which is projected forward and away from the shooter and individuals who may be positioned lateral to the device or the user of the weapon. Projecting away from the shooter and individuals who may be positioned lateral to the user is also realized as no side ports are included on the muzzle brake.

A size ratio of diameter of the throat section 115 to a diameter of the exit 125 and the configuration of the divergent section 120 therebetween is determinative by a speed a bullet exits the firearm. In general, exit speeds may range from Mach 2 to Mach 4, depending on the type of firearm. The ratio of the diameter of the throat section 115 to the exit 125 of the diverging section 120 may be approximately 0.34 inches, plus or minus 0.14 inches. The diameter of the throat section 115 may be arranged based on the bullet caliber used to ensure that the firearm safely accommodates a size of bullet.

In other embodiments, the converging section 110 may have an initial diameter of approximately 0.6 inches. The converging section 110 parabolically converges to the throat section 115, where the narrowest part of the throat section 115 may be approximately 0.34 inches or has a radius of approximately 0.17 inches. The narrowest part of the throat section 115 may reach approximately 0.34 inches within the throat section 115 from the start of the converging section 110. The throat section 115 parabolic diverges to the diverging section 120. The diverging section 120 may begin at approximately 0.34 inches and then have a parabolic expansion to approximately 0.9 inches. Therefore, the length from the narrowest part of the throat section 115 to the exit of the muzzle may be approximately 1.66 inches, plus or minus 0.5 inches. A ratio of the inlet diameter of the converging section 110 to the narrowest diameter of the throat section may be a ratio of between 1.5 to 2.0, where a preferred ratio is 1.76. A length ratio from the beginning of the converging section 110 and ending at the narrowest location of the throat section 115 compared to the narrowest location of the throat section 115 to an end of the parabolic expansion (where a bullet exits the parabolic expansion) may range from 0.3 to 0.4 where a preferred ratio is 0.38. The dimensions associated with these ratios may be adjusted to accommodate a firearm caliber, up to .50 caliber. The diameter ratio between the narrowest part of the throat section 115 to the beginning of the conversion section may range from 0.5 to 0.6 where a preferred ratio is 0.56. The ratios may be varied or adjusted to provide muzzle sufficient to a particular bullet caliber, ranging between 0.22 to .308 caliber bullets. The measurements and ratios discussed above are not limiting and are only shown as an embodiment. Instead, they are provided to further illustrate the arrangement of the embodiments taught herein.

In addition to reducing overpressure, embodiments described herein, namely, the parabolic configurations discussed, also reduce a shooter's signature as a flash signature and thermal signature are each reduced. More specifically, using an embodiment disclosed herein, a flash seen when the firearm is fired is less intense as the flash is directed in the same direction the bullet travels once the bullet leaves the firearm. A thermal signature is infrared energy emitted by an object where the hotter an object is, the more radiation it emits. The embodiments disclosed herein result in a firearm having a less intense or less radiation emitted when the firearm is fired. Hence, viewing when the firearm is fired such as through a night vision device, or infrared detector, is less reliable for determining a firing when an embodiment disclosed herein is used.

In decreasing overpressure, the embodiments disclosed herein may also reduce a sound emitted when the weapon is fired. However, the reduction in sound is not comparable to using a suppressor on a weapon, as the suppressor provides for less sound. Furthermore, the BOP experienced from prior art firearms can also affect how a user is using the firearm, namely, BOP may result in impairment of a shooter's sight picture or ability to fire the weapon temporarily as a shockwave from pressure may contact the shooter's eyes and/or hands. With the embodiments disclosed herein, these negative effects are minimized.

Figure 3:
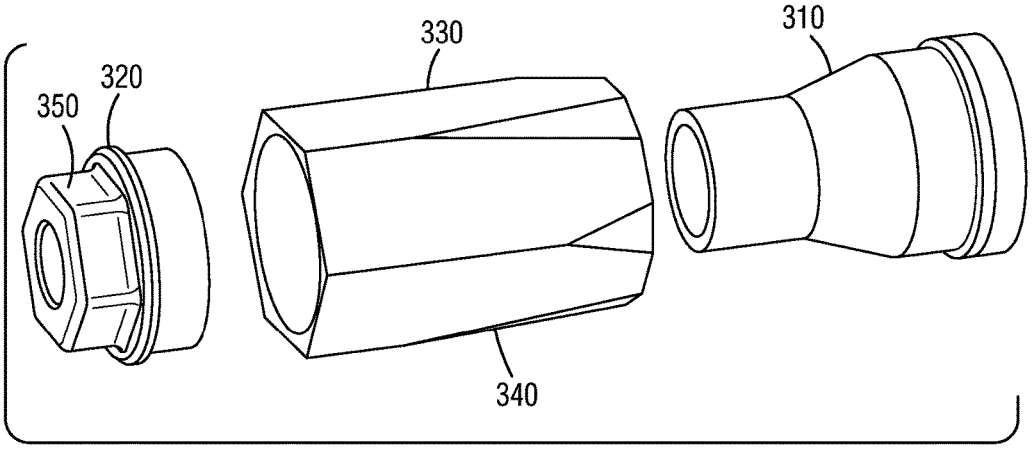
FIG. 3 shows an embodiment of the muzzle with the muzzle separated in distinct parts.

FIG. 3 shows an embodiment of the muzzle with the muzzle separated in distinct parts. The parts are also shown in FIG. 2. A first part 310 and a second part 320 may fit within a third part 330 to form the muzzle 100 as disclosed herein. The third part may be the outer surface 340 of the muzzle 100. The first part 310 may comprise the converging section 110, throat section 115 and diverging section 120, including the exit 135, of the muzzle 100. The second part 320 engages the first section 310 within the third section 330. The second part 320 engages the firearm 100. Thus, as illustrated, the second part 320 has an opening therethrough for the bullet to pass from a firing chamber to the muzzle 100.

Though the muzzle 100 is shown as having three parts, having three parts is not limiting. The muzzle 100 may be constructed from a single piece of material or manufactured using an additive manufacturing process so that the muzzle is a single piece.

Figure 4:
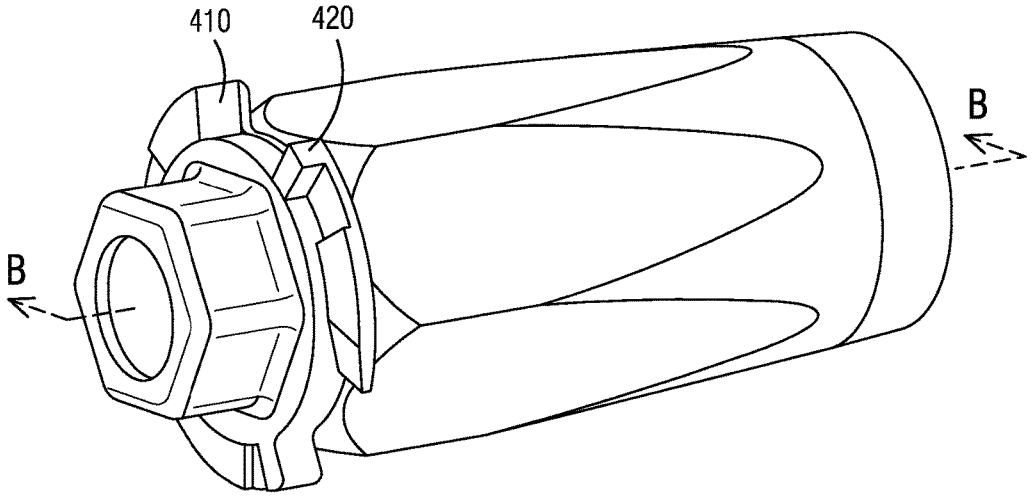
FIG. 4 shows another embodiment of a muzzle with an attachment/detachment component to accommodate a suppressor.
Figure 9:
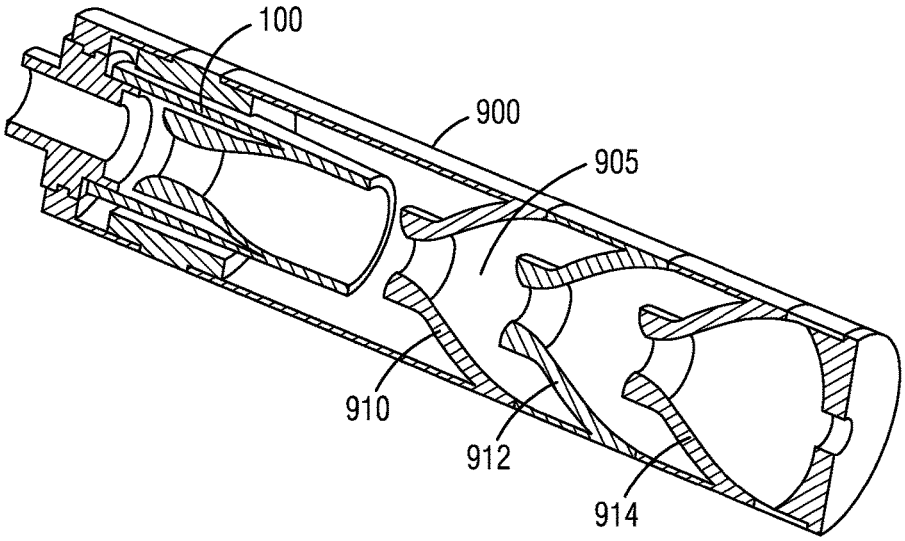
FIG. 9 shows a cross section of FIG. 9 taken along C-C.

FIG. 4 shows an embodiment of the muzzle with a connector component. The connector component 410 is provided to accommodate a suppressor, 900 as shown in FIG. 9. The suppressor 900 would pass over an outer part of the third part 330 of the muzzle 100 and then connect or attach to the muzzle 100 at an attachment component 420.

Figure 5:
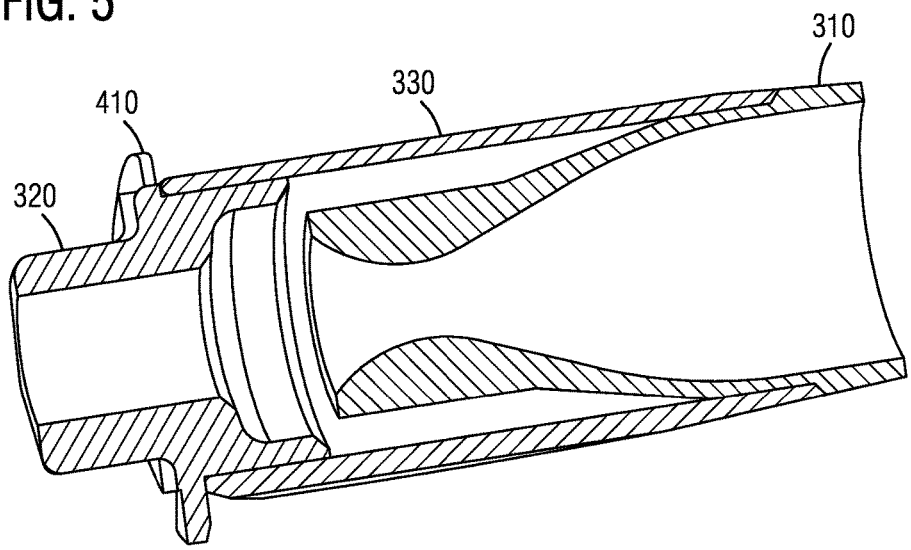
FIG. 5 shows an embodiment of the muzzle taken along B-B of FIG. 4.
Figure 6:
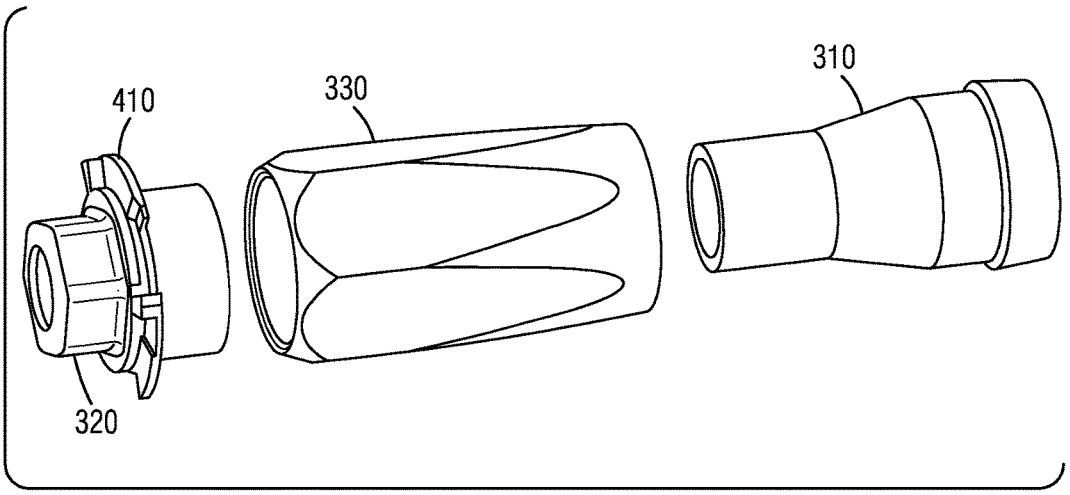
FIG. 6 shows an embodiment of the muzzle of FIG. 2 with the muzzle separated into distinct parts.

FIG. 5 shows a cross-section of FIG. 4 taken along section B-B, and FIG. 6 shows the muzzle of FIG. 4 separated in distinct parts. As shown, the connector component 410 may be made or included as part of the second part 320.

Figure 7:
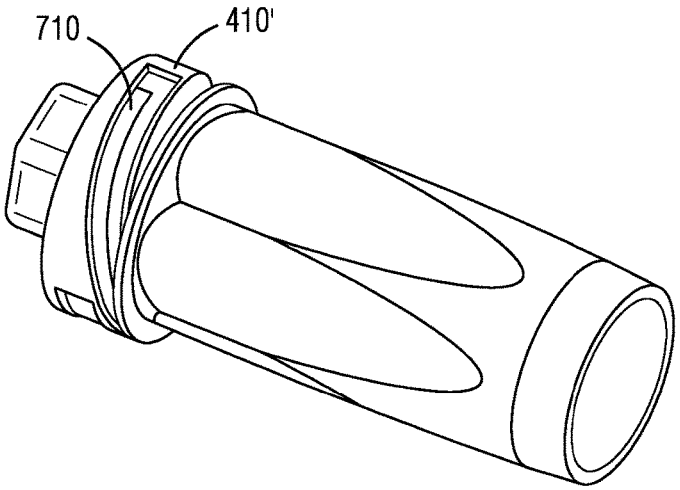
FIG. 7 shows another embodiment of a muzzle with another embodiment of an attachment/detachment component to accommodate a suppressor.

FIG. 7 shows an outer surface of another embodiment of a muzzle 100' with a different arrangement for the connector component. As shown, instead of the connector component 410' extending from the third part 330, grooves 710 are provided to engage an extension that is a part of the suppressor 900.

Figure 8:
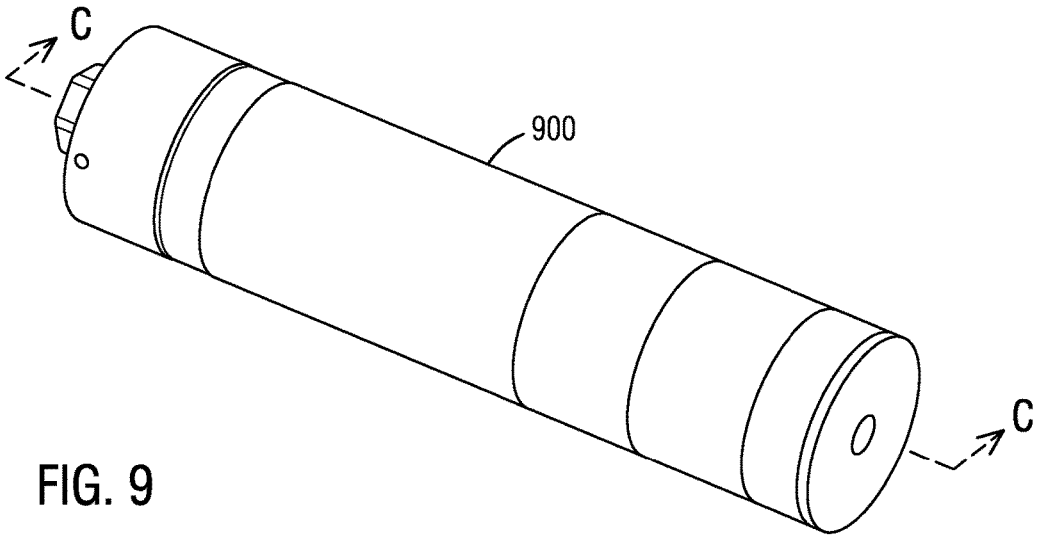
FIG. 8 shows an embodiment of the suppressor mated with a muzzle.

FIG. 8 shows an embodiment of the suppressor mated with a muzzle, and FIG. 9 shows a cross section of FIG. 9 taken along C-C. The suppressor 900 and muzzle 100' mated or attach also provide for a firearm overpressure reduction system. After the muzzle 100, a plurality of converging/diverging baffles 910, 912, 914 are shown. The baffles 910, 912, 914 may be modified k-baffles in which the baffles comprise a parabolic shape with an inlet section that converges and then diverges, as shown. As further shown, three baffles 910, 921, 914 are included. Depending on the desired sound suppression, more baffles such as, but not limited to, up to 8, or less baffles may be included in the suppressor 900. The three-baffle design provides for three stages of sound suppression with the first stage being between the muzzle 100 and the first baffle 910.

Figure 10:
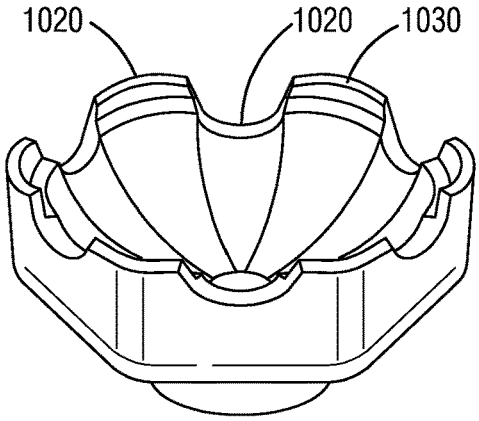
FIG. 10 shows an embodiment of a plurality of baffles.

FIG. 10 shows an embodiment of a plurality of baffles as discussed above with respect to FIG. 9. The baffles have sections removed 1010 at an edge 1020 of an exit end 1030 of the respective baffles 910. The benefits of the removed sections 1010 is to further expand the gas created when the bullet is fired by providing an exit port or expansion port 1010 for gasses that are created when a bullet is fired. This allows the gas to expand to the chamber 905 between a respective baffle and the interior of the tube 910 of the suppressor 900. Though the expansion port 1010 are shown as semi-circles, other arrangements may be used. The removal of parts, or exit port, may provide for a non-level surface along an edge of the end of the baffle to allow gas to escape. As a non-limiting example, the exit end 1020 may have an edge that has a waved arrangement, where the waves do not necessarily have to be uniform around the circumference or edge. Though FIG. 10 shows the baffle 910 having a hexagonal shape for an outer surface, other shapes are possible. As shown above, the outer shape may be circular. Furthermore, as shown in FIG. 10, the plurality of baffles may be aligned in a uniform arrangement where a respective side of the hexagonal shaped baffles are in a same plane. However, other arrangements are possible. With respect to hexagonal shaped baffles, the corners may be arranged to be offset by 30 degrees, as a non-limiting example of another arrangement.

Figure 11:
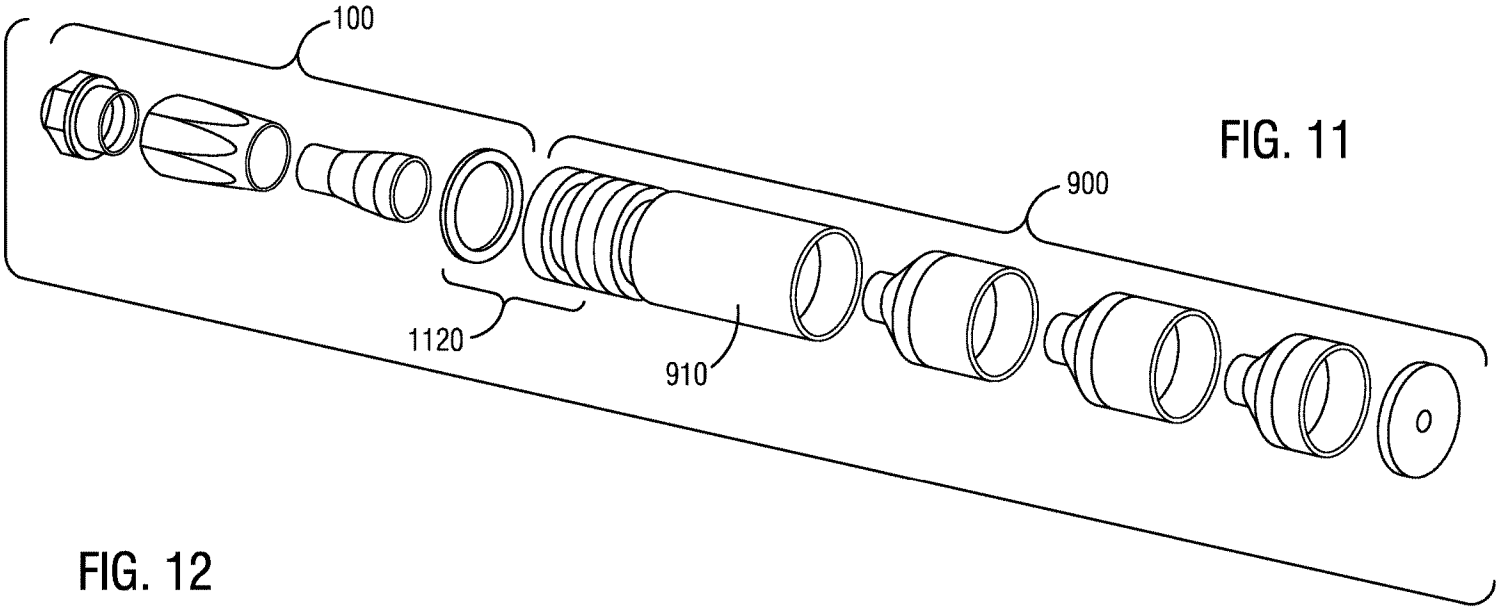
FIG. 11 shows an embodiment of the suppressor and muzzle where both the suppressor and muzzle are in separate parts.

FIG. 11 shows an embodiment of the suppressor and muzzle where both the suppressor and muzzle are in separate parts. The suppressor 900 comprises a body 910 into which the baffles 910, 912, 914 are located. A connection part 930 is provided at the end of the suppressor that engages the muzzle. The suppressor is arranged to slide or fit over the muzzle and is then lockable to the muzzle. Though the suppressor is shown as a separate part, in an embodiment, the suppressor may comprise the suppressor and the muzzle, as disclosed herein, as a unitary component.

Figure 12:
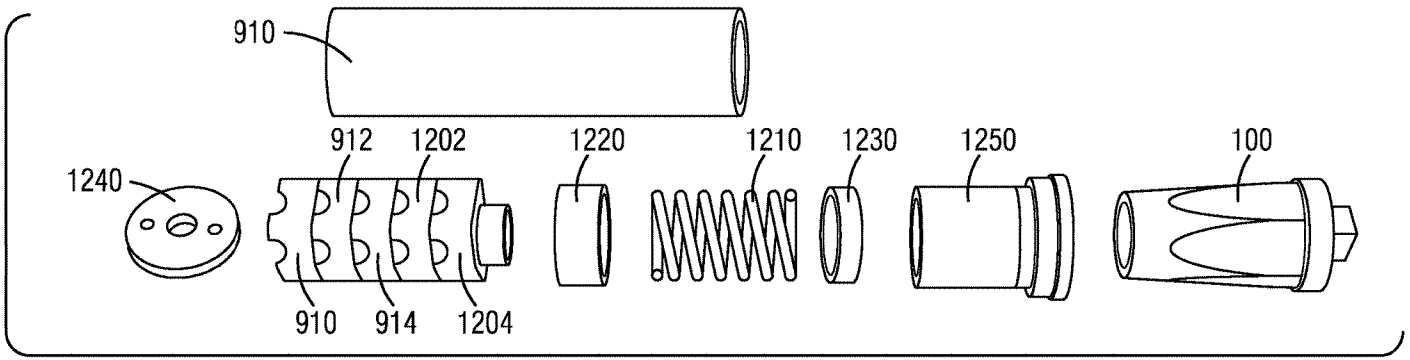
FIG. 12 shows another embodiment of the suppressor and muzzle where the suppressor is in parts.

FIG. 12 shows another embodiment of the suppressor and muzzle where the suppressor is in parts. As shown, the body 910 is visible. The baffles, 910, 912, 914, 1202, and 1204 are shown. As shown, the baffles are aligned so that respective sides of each baffles are aligned in a same plane. As discussed above, other arrangements are possible. A coil, or spring, 1210 may be provided, shown. A first spacer 1220 may located at a first end of the spring 1210. A second spacer 1230 may be located at a second end of the spring 1210. The spacers 1220, 1230 may be provided to hold or secure the baffles in place. An end faceplate, or cap, 1240 may be located at a first end of the body 910. The cap 1210 may have threads that engage receiving threads within an inner edge of the body 910. Other securing arrangements may also be used, therefore what is disclosed is not limiting. A mounting device 1250 may be located at a second end of the body 910. The muzzle 100 fits within the mounting device 1250.

Figure 13:
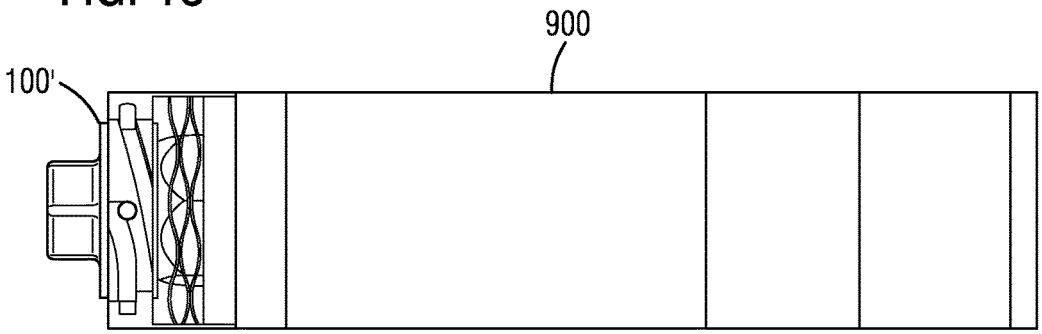
FIG. 13 shows an embodiment of the suppressor with a section of an outer cover being transparent to show the suppressor engaging the muzzle.

FIG. 13 shows an embodiment of the suppressor with a section of an outer cover being transparent to show the suppressor engaging the muzzle. As a non-limiting example, the muzzle 100 may have a three-lug connection device that engage with receivers in the mounting device 1250 so that when the muzzle is rotated, the muzzle 100 is locked into place.

Figure 14:
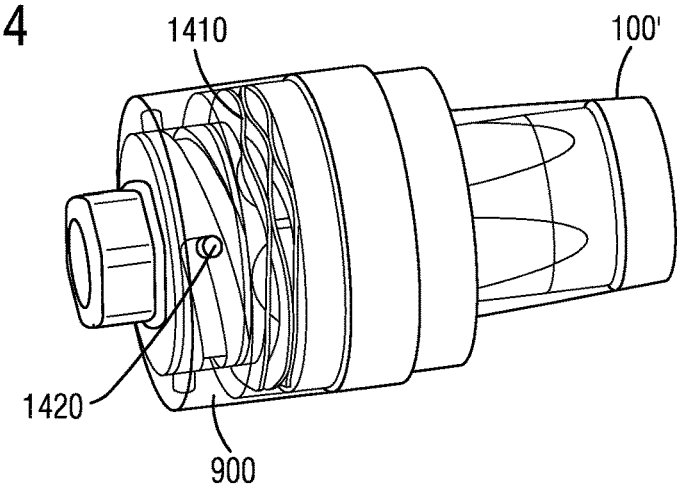
FIG. 14 shows another embodiment of the end of the suppressor engaging the muzzle with the outer cover of the suppressor shown transparent to see inner components.

FIG. 14 shows another embodiment of the end of the suppressor engaging the muzzle with the outer cover of the suppressor shown transparent to see inner components. This embodiment of the suppressor is connected to the muzzle 100' shown in FIG. 7. A wave locking spring 1410 is provided. The wave spring 1410 asserts a positive tension against a face that extends from the muzzle 100'. As the suppressor 900 engages the muzzle 100', the wave spring 1410 pushes away from the muzzle until muzzle is locked in place by way of the pins. Thus, as shown, pins 1420 extend within the opening of the suppressor 900 that engage a groove which has a locking area where the pins may be locked in place, hence securing the suppressor to the muzzle. The muzzle interacts with the suppressor to provide for co-centricity to provide for proper alignment so that the inner diameter of the suppressor is in close tolerance with outer surface of the muzzle. Therefore, there is linear alignment of the openings from the muzzle 100' through the suppressor 900. Other arrangements of the connector component to the suppressor is possible such as, but not limited to, a threaded arrangement. Thus, what is provided is an overpressure device that is directly connected to a suppressor.

Figure 15:
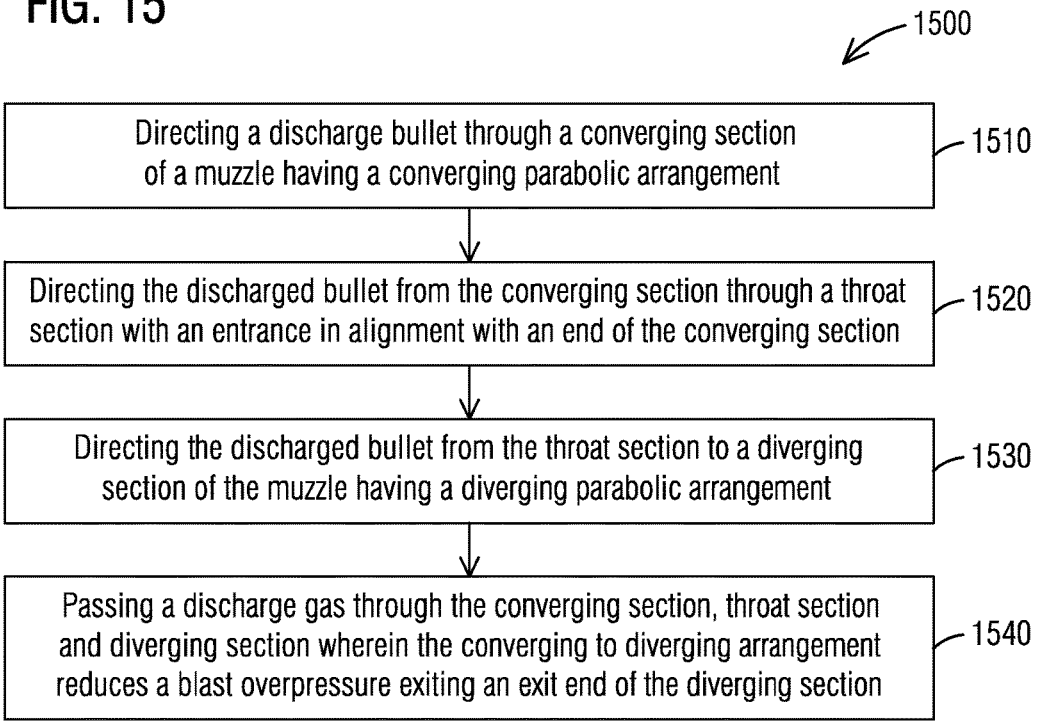
FIG. 15 is a flowchart showing an embodiment of a method disclosed herein.

FIG. 15 is a flowchart showing an embodiment of a method disclosed herein. The method may be for reducing blast overpressure from a firearm discharge. The method 1500 comprises directing a discharged bullet through a converging section of a muzzle having a converging parabolic arrangement, at 1510. The method 1500 further comprises directing the discharged bullet from the converging section through a throat section with an entrance in alignment with an end of the converging section, at 1520. The method 1500 further comprises directing the discharged bullet from the throat section to a diverging section of the muzzle having a diverging parabolic arrangement, at 1530. The method 1500 further comprises passing a discharge gas through the converging section, throat section and diverging section wherein the converging to diverging arrangement reduces a blast overpressure exiting an exit end of the diverging section, at 1540.

Figure 16:
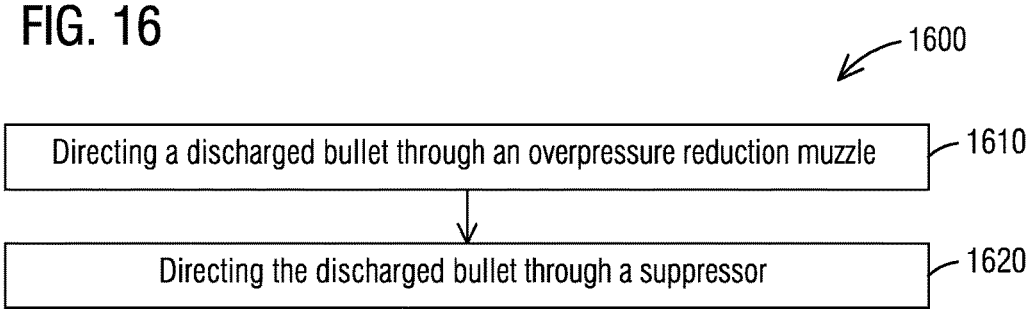
FIG. 16 is a flowchart showing another embodiment of a method disclosed herein.

FIG. 16 is a flowchart showing an embodiment of another method disclosed herein. The method 1600 may be for further reducing blast overpressure from a firearm discharge. The method 1600 comprises directing a discharged bullet through an overpressure reduction muzzle, at 1610 and directing the discharged bullet through a suppressor, at 1620.

The method 1600 may further comprise, within the overpressure reduction muzzle, directing a discharged bullet through a converging section of a firearm muzzle having a converging parabolic arrangement. Furthermore, within the overpressure reduction muzzle, the method 1600 may further comprise directing the discharged bullet from the converging section through a throat section with an entrance in alignment with an end of the converging section. The method 1600 may also comprise within the overpressure reduction muzzle, directing the discharged bullet from the throat section to a diverging section of the muzzle having a diverging parabolic arrangement. The method 1600 may also comprise, within the overpressure reduction muzzle, passing a discharge gas through the converging section, throat section and diverging section wherein the converging to diverging arrangement reduces a blast overpressure exiting an exit end of the diverging section.

The method may also comprise, within the suppressor, directing the discharged bullet though at plurality of baffles within the suppressor with at least one baffle having a converging arrangement at a first end through which a bullet passes and a parabolic shaped diverging arrangement at a second end through which the bullet exits the baffle.

Thus, as shown, embodiments herein show an overpressure reduction muzzle. In other embodiments, the overpressure reduction muzzle is mated with a suppressor. This is an improvement over the prior art as the prior art teaches a standard muzzle break being attached to a suppressor.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

I claim:

1. A firearm overpressure reduction system, the system comprising:

an overpressure reduction muzzle; and a suppressor;

wherein the suppressor is mated with the muzzle and wherein the suppressor further comprises a plurality of baffles within the suppressor with at least one baffle having a converging arrangement at a first end of the baffle through which a bullet passes and a parabolic shaped diverging arrangement at a second end through which the bullet exits the baffle; and wherein the at least one baffle with the parabolic shaped diverging arrangement at the second end of the baffle has the second end of the baffle arranged with a part of the second end removed to provide for a gas exit port.

2. The system according to claim 1, wherein the overpressure reduction muzzle comprises a converging section, a throat section and a converging section and wherein the converging section is in direct communication with the throat section which is in direct communication with the converging section.

3. The system according to claim 1, wherein the converging arrangement of the muzzle has a converging parabolic arrangement and the diverging arrangement has a diverging parabolic arrangement that leads to an exit area for a bullet fired.

4. The system according to claim 1 wherein each baffle of the plurality of baffles provides for different stage of sound suppression.

5. The system according to claim 1, wherein the suppressor further comprises a coil and at least one spacer to hold the plurality of baffles within the suppressor.

6. The system according to claim 1, further comprising a mounting device to mate the muzzle to the suppressor.

7. A method of reducing blast overpressure from a firearm discharge, the method comprising:

directing a discharged bullet through an overpressure reduction muzzle; and directing the discharged bullet through a suppressor mated with the muzzle, wherein the suppressor comprises a plurality of baffles within the suppressor with at least one baffle having a converging arrangement at a first end of the baffle through which a bullet passes and a parabolic shaped diverging arrangement at a second end through which the bullet exits the baffle, and wherein the at least one baffle with the parabolic shaped diverging arrangement at the second end of the baffle has the second end of the baffle arranged with a part of the second end removed to provide for a gas exit port.

8. The method according to claim 7, further comprising:

within the overpressure reduction muzzle, directing a discharged bullet through a converging section of a firearm muzzle having a converging parabolic arrangement;

within the overpressure reduction muzzle, directing the discharged bullet from the converging section through a throat section with an entrance in alignment with an end of the converging section;

within the overpressure reduction muzzle, directing the discharged bullet from the throat section to a diverging section of the muzzle having a diverging parabolic arrangement; and within the overpressure reduction muzzle, passing a discharge gas through the converging section, throat section and diverging section wherein the converging to diverging arrangement reduces a blast overpressure exiting an exit end of the diverging section.

9. The method according to claim 7, further comprising:

within the suppressor, directing the discharged bullet through the plurality of baffles within the suppressor with at least one baffle having a converging arrangement at the first end through which a bullet passes and a parabolic shaped diverging arrangement at the second end through which the bullet exits the baffle.

10. The system according to claim 1, wherein the suppressor further comprises a removable end cap to provide access to at least one of add and remove at least one baffle when the removable end cap is removed.

* * * * *